US009907375B1

(12) United States Patent
Kitchen

(10) Patent No.: US 9,907,375 B1
(45) Date of Patent: Mar. 6, 2018

(54) ELECTROMAGNETIC SHIELDING CARD CASE FOR CONTACTLESS AND CHIP AND PIN CARDS

(71) Applicant: Michael William Kitchen, Media, PA (US)

(72) Inventor: Michael William Kitchen, Media, PA (US)

( * ) Notice: Subject to any disclaimer, the term of this patent is extended or adjusted under 35 U.S.C. 154(b) by 0 days.

(21) Appl. No.: 15/455,271

(22) Filed: Mar. 10, 2017

(51) Int. Cl.
*H05K 9/00* (2006.01)
*A45C 11/18* (2006.01)
*A45C 1/06* (2006.01)
*A45C 13/00* (2006.01)

(52) U.S. Cl.
CPC ..... *A45C 11/182* (2013.01); *A45C 1/06* (2013.01); *A45C 13/005* (2013.01); *A45C 2001/062* (2013.01); *A45C 2001/065* (2013.01); *A45C 2001/067* (2013.01); *A45C 2011/186* (2013.01)

(58) Field of Classification Search
CPC ... A45C 1/06; A45C 11/182; A45C 2001/065; B42F 7/14; G07D 9/002
USPC ..... 150/137, 131, 132, 133, 138, 147; 206/216, 232, 234, 307; 174/350, 377
See application file for complete search history.

(56) References Cited

U.S. PATENT DOCUMENTS 3,648,832 A * 3/1972 Kirshenbaum ..... A45C 11/184 206/37
4,202,445 A * 5/1980 Porter ..... A45C 11/182 206/37
5,125,505 A * 6/1992 Kurosaki ..... A45C 11/182 206/38
5,718,329 A 2/1998 Ippolito et al.
5,791,461 A * 8/1998 Tsuge ..... A45C 11/182 206/39.4
6,082,422 A 7/2000 Kaminski
6,121,544 A 9/2000 Petsinger
7,163,152 B2 1/2007 Osborn et al.
7,482,925 B2 1/2009 Hammad et al.
8,567,459 B2 * 10/2013 Kitchen ..... A45C 11/182 150/147
8,662,293 B2 * 3/2014 Lazott ..... A45C 11/182 206/39.4
8,921,693 B2 * 12/2014 Benedetto ..... G02B 6/4441 174/50
8,985,387 B2 * 3/2015 Kobayashi ..... A45C 11/182 221/154
8,989,826 B1 * 3/2015 Connolly ..... A45C 1/06 361/679.01

(Continued)

*Primary Examiner* — Fenn C Mathew
*Assistant Examiner* — Cynthia Collado

(57) ABSTRACT

An improved electromagnetic shielding card case comprising a front panel hingedly connected to a U-shaped member and a base member which sandwich an electromagnetic shielding member between them. A card slot is defined on its top by U-shaped member, its bottom by the shielding member, and its left, right and rear sides by a continuous inner wall extending downwards from the U-shaped member, whereby cards are able to be slidably inserted and removed at the front end of the case and shields cards inside the slot from RFID scanning. A resilient means frictionally engages the edges of cards in the slot so a user can shuffle through cards without any falling out, and allows the topmost card to be pushed forward and easily inserted into a chip and pin card reader. A soft rubber strap affixed to the back of the base member allows paper currency to be held securely.

17 Claims, 9 Drawing Sheets

(56) References Cited

U.S. PATENT DOCUMENTS

| | | | | |
|---|---|---|---|---|
| 2014/0014576 | A1* | 1/2014 | Jeong | B01D 61/025<br>210/500.41 |
| 2014/0203020 | A1* | 7/2014 | Trombino | A45C 11/00<br>220/500 |
| 2016/0014922 | A1* | 1/2016 | Banerjee | A45C 7/0031<br>206/38 |

* cited by examiner

ELECTROMAGNETIC SHIELDING CARD CASE FOR CONTACTLESS AND CHIP AND PIN CARDS

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND—FIELD OF INVENTION

This invention relates to card cases, and more specifically to wallet-sized electromagnetic shielding or RFID blocking card cases for holding and protecting personal articles such as credit cards, debit cards, chip and pin cards, contactless smartcards, licenses, identification cards, paper currency, receipts, tickets, and the like.

PRIOR ART

Contactless smartcards are wallet-sized cards that are being marketed to consumers as an alternative to magnetic strip cards as a convenient way for storing financial and personal data. By virtue of their ability to store relatively large amounts of data on an embedded microchip, and the convenience of not having to swipe the card through a scanner or hand it to a cashier, it is projected that these cards will only continue to multiply in the coming years in the fields of banking, transportation, healthcare, insurance, social security, and other personal data. The chips used in contactless smartcards can be manufactured in a form called an RFID chip, wherein RFID stands for Radio Frequency Identification. Contactless smartcards may also be referred to as RFID enabled cards.

In order to obtain the personal information contained on a smartcard, an RFID reader or sensor needs to be present. The RFID reader provides power to the embedded microchip via a modulated magnetic field, allowing the information to be obtained from the card. Assuming that the smartcards are not shielded by an electromagnetic-shielding enclosure, the smartcards can be powered up and accessed without the card owner's knowledge. This can typically occur in two different scenarios. In one scenario, the unauthorized scanning of an RFID enabled card can be accidental, wherein the card owner is unaware that they have come within range of an active RFID reader. In another scenario, the scanning of the card might be intentionally executed by a party who is interested in obtaining the card owners personal information without their consent. This party may have their own RFID reader which they use for this purpose. The latter scenario is an example of what has become known as RFID theft, a new and rapidly growing form of identity theft. In both of these scenarios, however, the user can no longer take a proactive role in securing information on their cards. This has led to a need for new types of wallets and card cases to prevent this unauthorized scanning.

Moreover, in light of a recent focus on data security, a new type of card called 'chip and pin cards' have become widely distributed and used in the United States. Chip and pin cards, also known as 'EMV cards,' are already widely used around the world and have just started being issued in the U.S. A chip and pin card is a standard-size plastic debit or credit card that contains an embedded microchip as well as a traditional magnetic stripe. The chip encrypts information to help increase data security when making transactions at terminals or ATMs that are chip-enabled. The cards are all typically inserted lengthwise into the bottom of most modern card readers and terminals and held there while the chip information is read, a personal PIN number is entered, and the transaction is complete, after which the card is allowed to be pulled out. Due to the fragile nature of the microchip that is exposed on these cards, it is not advisable to carry them in a traditional leather or fabric wallet, as the chip could be easily bent or broken under compressive forces from being in a pocket or bag, and result in malfunction of the card at the terminal. Hence, there exists a strong new need for wallets and cases that have crush resistance and protect cards contained within.

A rapidly growing trend in the wallet industry is to make very thin and minimal card cases and wallets, also known as 'minimalist wallets,' which attempt to remain as thin and compact as possible while holding a moderate amount of cards inside. The issue with these types of card cases and wallets is that there is usually just one card slot, and it is very hard to see or access your cards because most of these cases make you eject cards outwards instead of opening like a traditional bi-fold wallet. Because of this, some minimalist card cases, as we will see in prior art, have various mechanisms for ejecting one or more individual cards out at a time, in order to allow a user to access a particular card more easily. Another big issue with these minimalist card cases and wallets is that they typically utilize a traditional flexible steel or plastic money clip affixed to their exterior that holds paper currency and the like. These money clips are usually sharp on their edges, have an upstanding lip on the ends, and are bulky and uncomfortable against one's leg while in pocket, sometimes even wearing a hole in a user's pants over time. So it can be argued there exists a need for a secure minimalist card case which allows a user to see the faces of their cards to identify them, works intuitively with new chip and pin card readers, shields cards inside from RFID scanning, is crush resistant, and has a paper currency holding system on their exterior which is not bulky, sharp or uncomfortable in pocket.

In trying to solve the above shortcomings of traditional wallets, we will first look at prior art that is concerned with securing the information on a contactless smartcard. U.S. Pat. No. 6,121,544 issued to Petsinger describes an electromagnetic shield to prevent unauthorized access to contactless smartcards. The smartcard is inserted into an opaque sleeve that covers the majority of the cards surfaces. A sheet of electromagnetic-shielding material in the form of a soft magnetic alloy is embedded within the sleeve. While in the sleeve, a contactless smartcard is shielded from being powered up by an RFID reader. While it does provide a secure RFID shielding body in the form of the sleeve, it has the following disadvantages:

(a) It is specifically made for a very small quantity of cards (typically one or two). The sleeve is meant to be carried in a users pocket or wallet, but this is unfavorable because it adds complication and time to removing RFID cards from a user's wallet.

(b) Because of the opaque nature of the electromagnetic-shielding material and its plastic shells, one cannot see through it. This prevents the user from seeing which card is stored inside the sleeve, which is undesirable in dimly lit environments or for people with poor vision.

(c) The sleeve does not have the capability to carry any additional personal items, such as paper currency, photographs, receipts, or other cards, making it a separate item that needs to be carried in addition to one's regular wallet.

(d) Petsinger teaches card retention ramps inside the card slot so the individual card is gripped by them and prevented from sliding out. If one skilled in the art were to modify Petsingers card sleeve to hold a plurality of cards, this card retention feature would no longer be effective as the bottom cards underneath the topmost card would have much less friction holding them all in place and risk falling out of the sleeve by accident, as there is no physical barrier preventing cards from sliding out when the sleeve is not in use.

U.S. Pat. No. 7,163,152 issued to Osborn et al. is very similar to Petsinger's invention and also has a lot of the same issues. Osborn teaches a protective case comprising a receptacle or base, and a lid both formed from ferromagnetic metal which together form a tight enclosure, and a polymeric insert in between that holds only one card and shields it from damaging magnetic fields. While it could be said this invention provides a secure RFID shielding enclosure for a magnetic or contactless smartcard, it has the following flaws:

(a) It only holds one card and is not practical by any means as an everyday carry wallet or case. Osborn's case is thick and oversized for holding just one card inside, and does not teach or describe an additional compartment for paper currency, receipts, or even more cards.

(b) If one skilled in the art were to expand the thickness of the case to hold more cards, it would make the case even bulkier, as the insert inside already creates gaps between the cards and the inner surfaces of the case via the polymeric insert. Moreover, the entire stack of cards would have to be picked up out of the case and sorted through by hand, which is clumsy and unintuitive.

(c) The case has an oversized lid that must be popped off and set aside somewhere to access the lone card inside, adding complication and time for a user trying to pay for an item quickly.

(d) There is nowhere to store paper currency or the like.

Other solutions have been presented for shielding smartcards in the form of conventional leather and fabric bi-fold wallets with one or more liners of electromagnetic-shielding material embedded somewhere within or attached to their outer panels. One particular reference that describes this common solution is U.S. Pat. No. 7,482,925 issued to Visa U.S.A. (herein Visa). Visa discloses several methods and apparatuses for shielding portable consumer devices such as contactless smartcards, which include envelopes with metalized coatings, electromagnetic shielding stickers attached to smartcards, and a conventional bi-fold wallet with an "RF shield liner" that is configured to be integrated with the wallet to shield smartcards contained inside it. While most of the embodiments that Visa describes are temporary security measures to protect and shield newly issued smartcards during transport through the mail to their owners, Visa also teaches a fairly standard bi-fold wallet with an "RF shield liner" integrated with its outer panels, and a holding pocket inside for containing smartcards. Visa states that the "RF shield liner" is configured to attenuate RF signals within the operation frequency range of the smartcard contained inside the holding pocket when the wallet is folded closed.

There are several serious issues with Visa's solution and with other RF shielding wallets that use this same method:

(a) These electromagnetic shielding wallets are made to be carried in one's pocket or handbag. However, while these traditional bi-fold type wallets are in one's pocket or handbag they have a tendency to pivot open slightly as a result of the user walking, running, or being jolted. When these wallets fold open even the slightest bit, the RF shield liner on the outside of the wallet also spreads open, and a breach is created in the RF shielding effect of the wallet, making the smartcards prone to accidental or unauthorized scanning.

(b) The card pockets within them are not closed off in any way, even when the wallet is folded closed. Again, as a result of the user walking, running, or being jolted in some way, the smartcards within the wallet are prone to sliding out of the sleeves, and even the slightest exposure of these smartcards outside of the RF shield liner can risk unauthorized and accidental scanning of the smartcard.

(c) The RF shielding liner inside needs to be flexible and is often substantially thin and flimsy, using materials such as aluminum foil. As a result of repeatedly folding open and closed with use, and being subjected to various forces while in one's pocket or bag, these RF shielding liners can easily crumple, tear, or crack, which can lead to a creation of a hole or gap in the electromagnetic shielding effect of the wallet.

(d) There is added labor and cost of manufacturing these kinds of wallets. The RF shielding liner becomes a costly appendage to the wallet instead of being an efficient, integral structural component. Not only does the leather or fabric have to be cut down to size and sewn together, but sheets of electromagnetic-shielding material have to be fabricated and cut down to size as well, only to be concealed within the outer panels of the wallet. It is an added cost and step in the manufacturing process that is often reflected in the retail price for these wallets.

(e) These traditional leather and fabric wallets will not protect contactless smartcards and chip and pin cards from compressive forces, and risks breaking the functionality of these types of cards.

In looking at prior art in the form of compact or minimalist card cases, we can look first towards U.S. Pat. No. 5,718,329 issued to Ippolito et. al. They teach a card compartment formed to retain a plurality of cards in a single stack by a retention clip which urges against the bottom of the stack to keep them inside, as well as a traditional style money clip on the outside. Ippolito's solution has the following flaws:

(a) There is no physical barrier to prevent cards from accidentally sliding out if the retention clip wears out over time.

(b) There is no way to physically see the topmost card or any card as they are concealed inside the panels.

(c) The money clip attached to the back is bulky, potentially sharp and uncomfortable against the leg in pocket.

(d) Ippolito does not teach any method of shielding cards inside from RFID scanning (e) The construction style of the case allows the card insertion end to be open without any wall element spanning across for support, which means the front opening will bow and bend easily under compressive forces and potentially damage cards contained within.

U.S. Pat. No. 6,082,422 issued to Storus Corp (herein "Storus") describes a combination money clip and card holder comprising a base with L-shaped brackets on one side which forms a channel to grip and hold cards allowing them to be slid out at the front open end with one's finger. This design has the following flaws:

(a) The L shaped brackets of the channel are tapered inwards toward a back stop so that as cards are inserted, cards bow upwards and deform as the side walls of the channels grip them. This will cause permanent deformation of the cards over time and they will no longer be held securely in the card channel, free to accidentally slide out of the front.

(b) Storus teaches a second stop portion in an alternate embodiment which would be on the insertion end of the card channel in order to prevent cards from sliding out. However in order to remove cards in this configuration one would have to physically bend the stack of cards upwards so they begin to clear the second stop wall, then pull out and remove the topmost cards one at a time without anything gripping them, which is clumsy and unintuitive.

(c) There is no physical barrier covering the cards on their exposed side, and Storus does not teach one, so cards on that side are prone to unauthorized RFID scanning, and card numbers are visible to others at all times (d) The money clip on back is of the traditional style and made of a resilient metal such as steel, the edges of which are sharp, hard and uncomfortable against the leg while carrying in pocket.

Hence, there exists a strong need in the art for a portable, crush resistant electromagnetic-shielding wallet or card case that works intuitively with chip and pin card readers and holds, shields and protects a plurality of contactless smartcards and chip and pin cards. The proposed case must also prevent cards from sliding out while in one's pocket or bag.

In addition to being able to hold and protect a plurality of cards, the proposed card case must also be able to hold paper currency, receipts, tickets, and the like using a soft, low profile element that is not sharp, protruding, or uncomfortable while in one's pocket.

SUMMARY OF THE INVENTION

The present invention is directed towards an improved electromagnetic shielding card case for contactless and chip and pin cards that is meant to be carried in one's pocket, bag, or purse. The card case comprises a front panel made from a metal alloy with electromagnetic shielding properties which is hingedly connected to a U-shaped member and a base member which sandwich an electromagnetic shielding member between them. A card slot is defined on its top by a continuous roof member on the U-shaped member which covers a small portion of the perimeter of the surface of the topmost card in a stack, its bottom by the shielding member, and its left, right and rear sides by a continuous inner wall, whereby cards are able to be slidably removed and inserted into the case at the front end. U-shaped member allows a substantial portion of the topmost cards face to be visible. The front panel has a continuous front wall which provides a barrier at the front end of the card slot when the case is locked shut via a releasable locking means, so that cards cannot accidentally slide out. A resilient means is disposed in the card slot which frictionally engages and grips the edges of a stack of cards in the card slot which allows a user to easily shuffle through cards without any falling out, and allows the topmost card to be ejected slightly and held with one's thumb as it is inserted into a chip and pin card reader. A soft rubber strap is affixed around the base member and allows paper currency and the like to be securely stored between the strap and the exterior surface of the base member.

It is a primary objective of this invention to provide an electromagnetic shielding card case that holds and shields a plurality of contactless smartcards contained within from being powered up and read by an RFID reader when the case is closed, and also prevent accidental opening while contained in one's pocket or bag by providing a releasable locking means that allows a user to quickly and easily lock the case shut.

It is another objective of this invention to construct the outer panels and members of the case out of a substantially rigid, durable material and configuration so as to protect the plurality of cards within from being bent, crushed, or broken with use.

It is another objective of this invention to provide electromagnetic shielding elements that are strong, resilient, and durable so as not to bend, tear, or degrade with use which could consequently create a breach in the electromagnetic shielding effect.

It is another objective of this invention to provide a card slot in the case which allows the user to easily see a substantial portion of the topmost cards face when the case is open, which is useful for accessing your most frequently used card in dimly lit environments or for people with poor vision.

It is another objective of this invention to provide a resilient means inside the card slot which frictionally engages and grips the edges of a stack of cards in the card slot and allows a user to easily shuffle the cards forwards without any falling out, and also allows the topmost card to be ejected out slightly and held with one's thumb so it can be quickly and easily inserted vertically into a chip and pin card reader.

It is another objective of this invention to provide a soft, low profile paper currency holding means on the back of the case so that paper currency, business cards, receipts and the like can be stored securely and the case can be comfortably carried in one's pocket.

It is yet another objective of this invention to provide an ejection means for pushing out the bottommost card in the card slot as a way of quickly accessing a particular card that is always stored on the bottom.

DRAWINGS - Reference Numerals

| | | | |
|---|---|---|---|
| 20 | hinge pin | 312 | low wall area for ejector arm |
| 22 | rubber tubes | 314 | tube bosses |
| 24 | compression spring | 316 | screw bosses |
| 26 | thread forming screws | 320 | first gap in continuous outer wall |
| 28 | rubber strap | 322 | barrier wall in first track |
| 30 | plurality of cards | 326 | hinge pin cradle portions |
| 32 | bottommost card | 328 | hinge pin retaining walls |
| 34 | paper currency | 330 | hole in roof member |
| 100 | base member | 334 | latch member |
| 104 | counter-bored holes in base member | 336 | tongue on latch member |
| 106 | strap trench | 338 | ribbed button on latch member |
| 108 | upstanding hooks | 342 | second gap in continuous outer wall |
| 110 | narrow trenches for high walls | 344 | ejecting member |
| 200 | electromagnetic shielding member | 346 | projecting arm on ejection member |
| 202 | slits in shielding member | 348 | ribbed button on ejecting member |
| 300 | U-shaped member | 400 | front panel |
| 302 | continuous roof member | 402 | continuous front wall |
| 304 | continuous inner wall | 404 | hook member on front panel |
| 306 | continuous outer wall | 406 | hinge members |
| 308 | ledge portions | 500 | electromagnetic shielding card case |
| 310 | high wall portions | | |

DETAILED DESCRIPTION OF THE PREFERRED EMBODIMENTS

Figure 8:
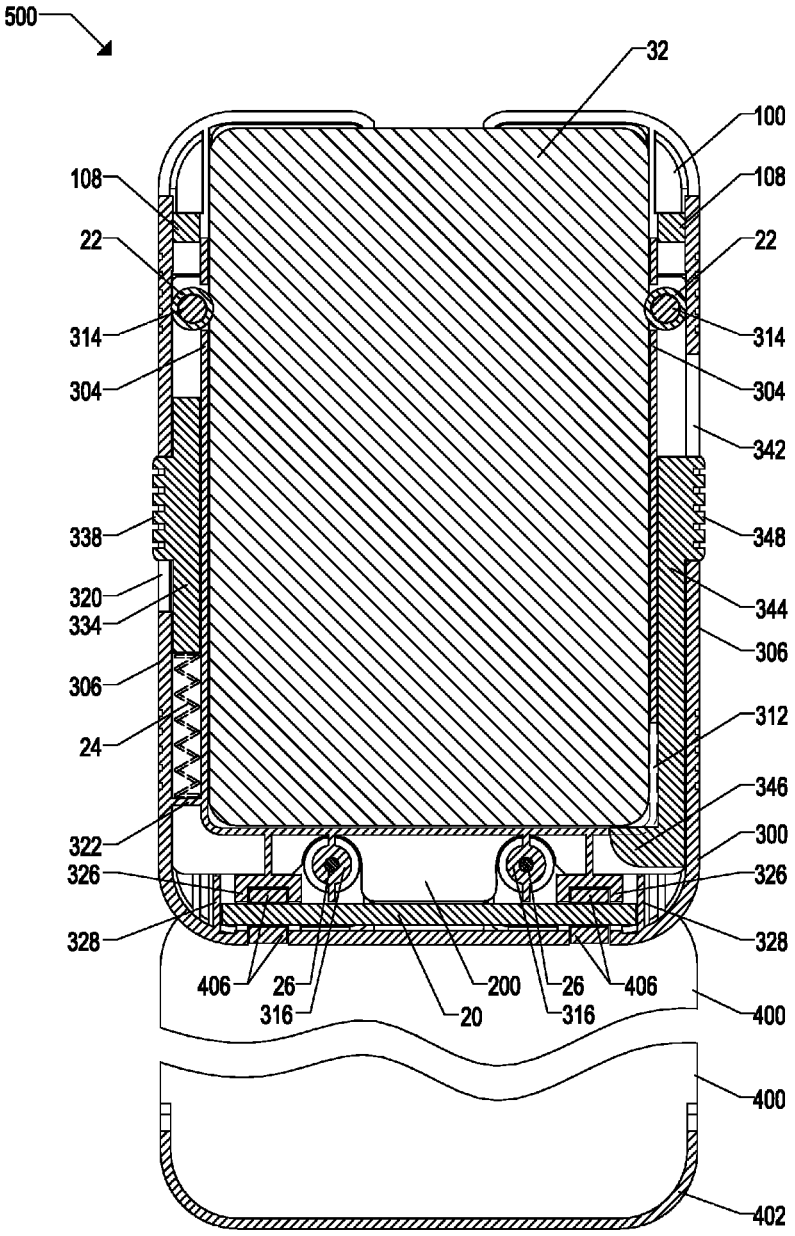
FIG. 8 illustrates schematically a horizontally cut section of the electromagnetic shielding card case in its open position.
Figure 9:
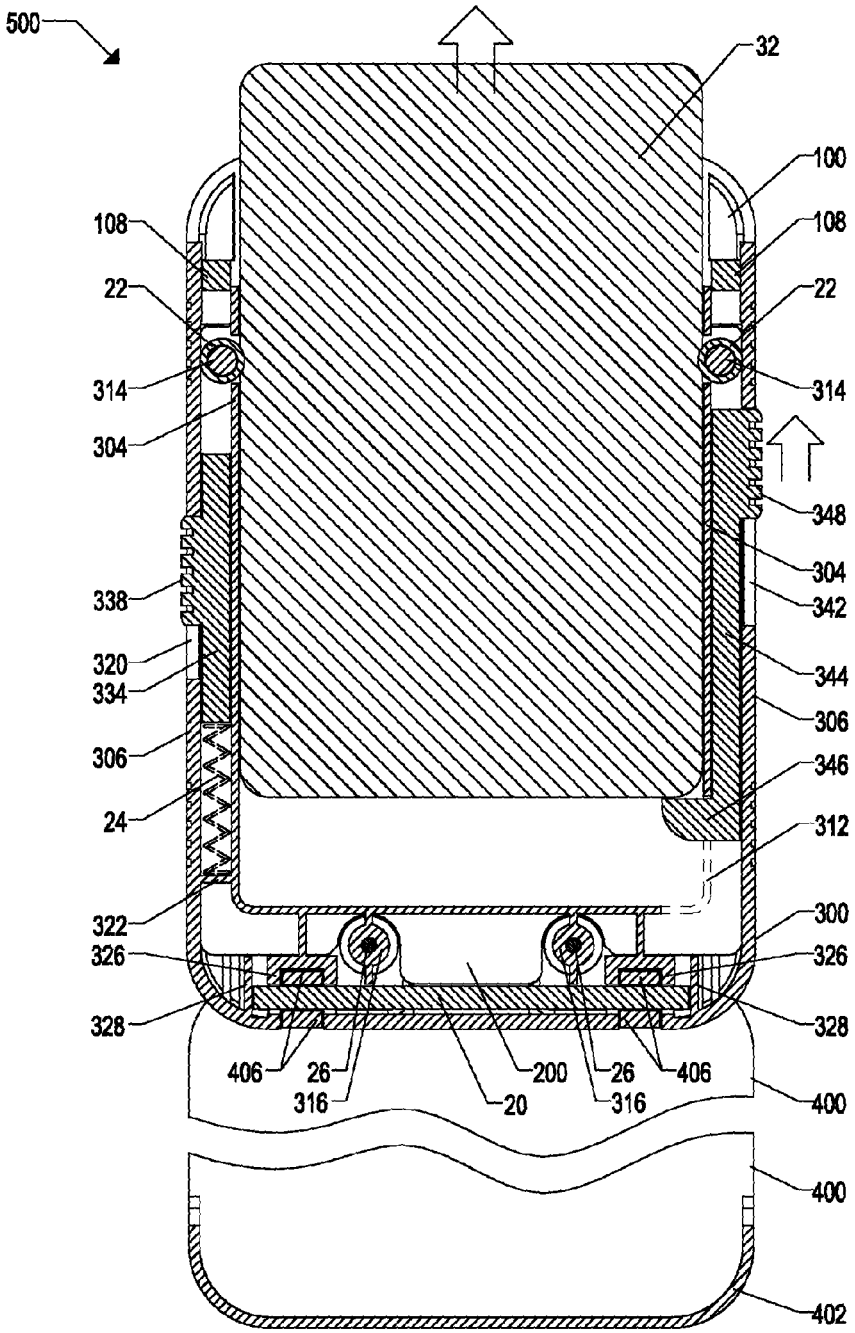
FIG. 9 illustrates schematically a horizontally cut section of the electromagnetic shielding card case in its open position when the ejecting member is pushed forwards to eject the bottommost card out of the case.
Figure 10:
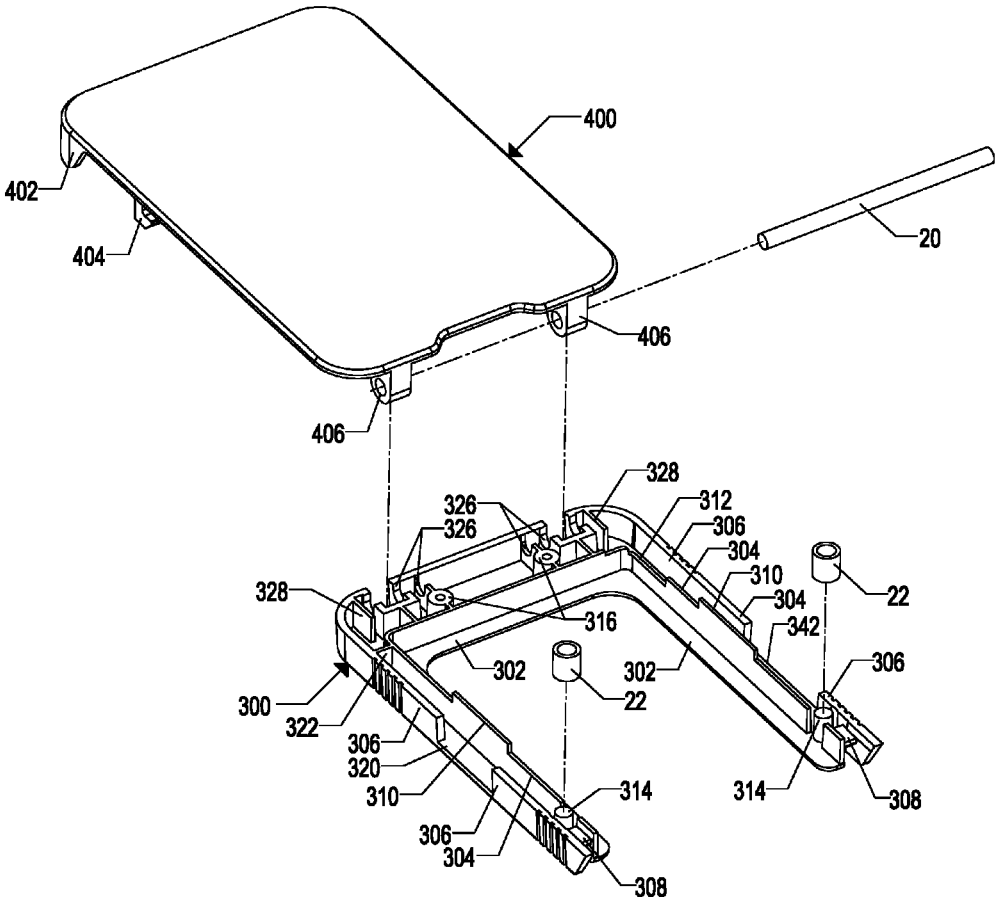
FIG. 10 illustrates schematically an axonometric view of how the front panel, hinge pin and U-shaped member are assembled together
Figure 11:
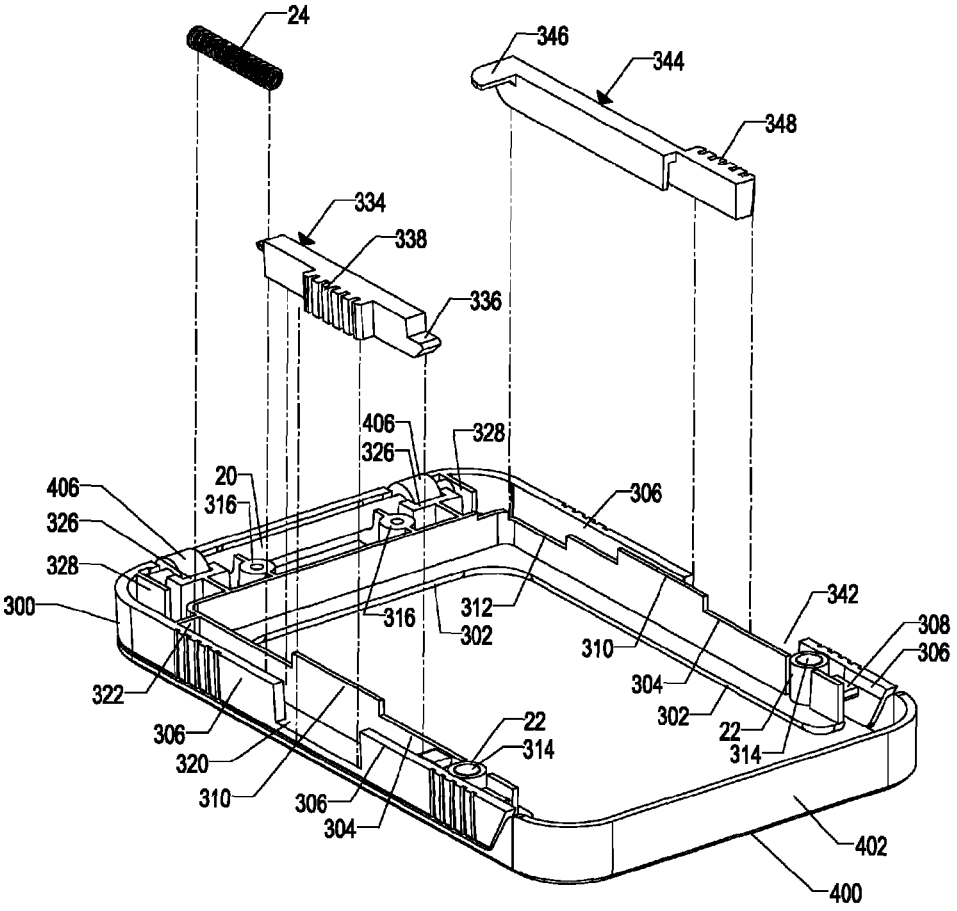
FIG. 11 illustrates schematically an axonometric view of how the latch member, compression spring and ejecting member are inserted into the first and second tracks.
Figure 12:
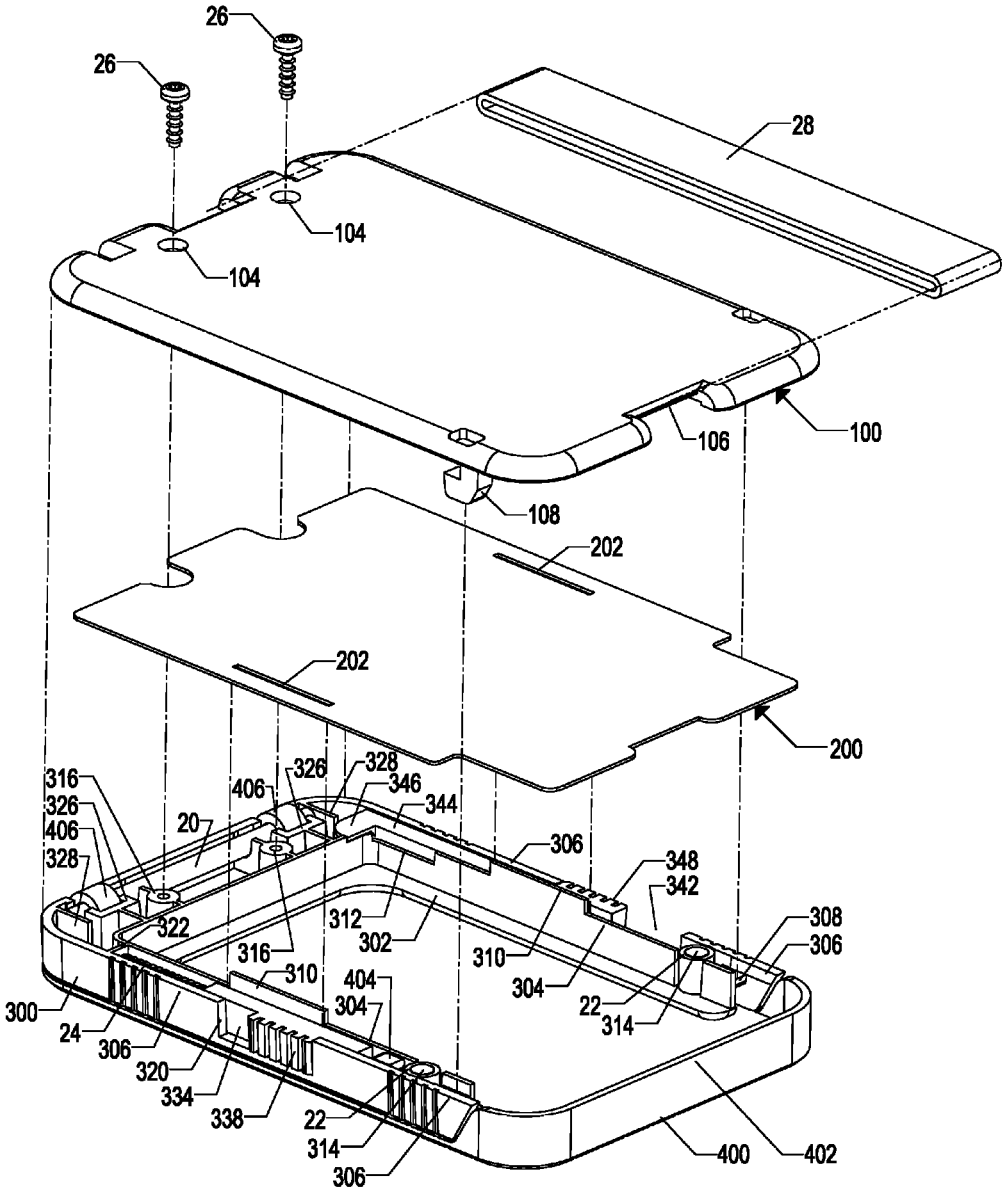
FIG. 12 illustrates schematically an axonometric view of how the shielding member, base member and rubber strap are stacked during assembly.

The electromagnetic shielding card case which is the preferred embodiment of the present invention is broadly denoted by the numeral 500 and is shown in its closed position in FIGS. 1, 2, 5, and 7, and in its open position in FIGS. 3, 3A, 4, 8, and 9. FIGS. 10, 11, and 12 show exploded perspective views of how card case 500 is progressively stacked and assembled.

The electromagnetic shielding card case 500 comprises a front panel 400 which is made from a metal alloy with sufficient electromagnetic shielding properties to shield a smartcard from being scanned and which is hingedly connected to base member 100 by hinge pin 20 which extends through the holes in hinge members 406 and is inserted into hinge pin cradles 326 on U-shaped member 300, as shown in FIG. 10. Hinge pin cradles 326 are walls with circular notches in the top which are shaped to receive hinge pin 20. Hinge pin retaining walls 328 surround hinge pin 20 on each of its ends to prevent it from moving laterally.

U-shaped member 300 is in the shape of a rectangular horseshoe open at one end and further comprises a continuous inner wall 304, a continuous outer wall 306, and a continuous roof member 302 all of which substantially extend along its U-shape and wrap around the card slot. Continuous roof member 302 extends horizontally over top of the card slot and continuous inner wall 304 and continuous outer wall 306 extend downwards perpendicularly from underneath it. Continuous outer wall 306 wraps around a pair of rectangular notches at the back of U-shaped member 300 and allows a pair of hinge members 406 to sit inside them.

Rubber tubes 22 are inserted around tube bosses 314 and frictionally engage the edges of plurality of cards 30 contained in the card slot. Front panel 400 further comprises a continuous front wall 402 at its front end which sits on top of the front edge of base member 100 (seen in FIG. 5), as well as a hook member 404 extending downwards from its bottom surface. When card case 500 is closed, hook member 404 extends through hole 330 in U-shaped member 300 and interacts with tongue 336 on latch member 334.

Looking at FIG. 11, latch member 334 sits within a first track which is defined on its sides by continuous inner wall 304 and continuous outer wall 306, its bottom by shielding member 200, and its top by a portion of the underside of U-shaped member 300 and is able to slide back and forth. Latch member 334 further comprises a tongue 336 and a ribbed button 338 which extends outwards and protrudes through first gap 320 in continuous outer wall 306, which can be seen in FIGS. 1, 3, 8, 9 and 12. Compression spring 24 sits between the back end of latch member 334 and barrier wall 322, as seen in FIG. 11 and sectionally in FIGS. 5 and 6. Compression spring 24 constantly urges against latch member 334 keeping it pushed forward, and the side edges of ribbed button 338 push against an edge of first gap 320 to prevent latch member 334 from sliding any further forwards (seen in FIGS. 8 and 9), and allows latch member 334 to slide between a locked position and an unlocked position. Compression spring 24 is shown as dashed in FIGS. 8 and 9 because it is located above those section cuts.

Ejecting member 344 sits within a second track which is defined on its sides by continuous inner wall 304 and continuous outer wall 306, its bottom by shielding member 200, and its top by a portion of the underside of U-shaped member 300 and is able to slide back and forth. Ejecting member 344 further comprises a ribbed button 348 which extends outwards and protrudes through second gap 342 in continuous outer wall 306, which can be seen in FIGS. 2, 4, 8 and 9. Both edges of ribbed button 348 can be slid against each edge of second gap 342 and allows ejecting member 344 to slide a specific distance forwards or backwards between an ejecting position (FIG. 9) and a resting position (FIG. 8). Ejecting member 344 further comprises a projecting arm 346. A low wall area 312 exists on a portion of continuous inner wall 304 and allows projecting arm 346 to freely slide back and forth underneath it. Projecting arm 346 extends over top of and lays against a back portion of the top surface of shielding member 200, as seen in FIGS. 8 and 9, and is the approximate thickness of a wallet-sized card.

Figure 1:
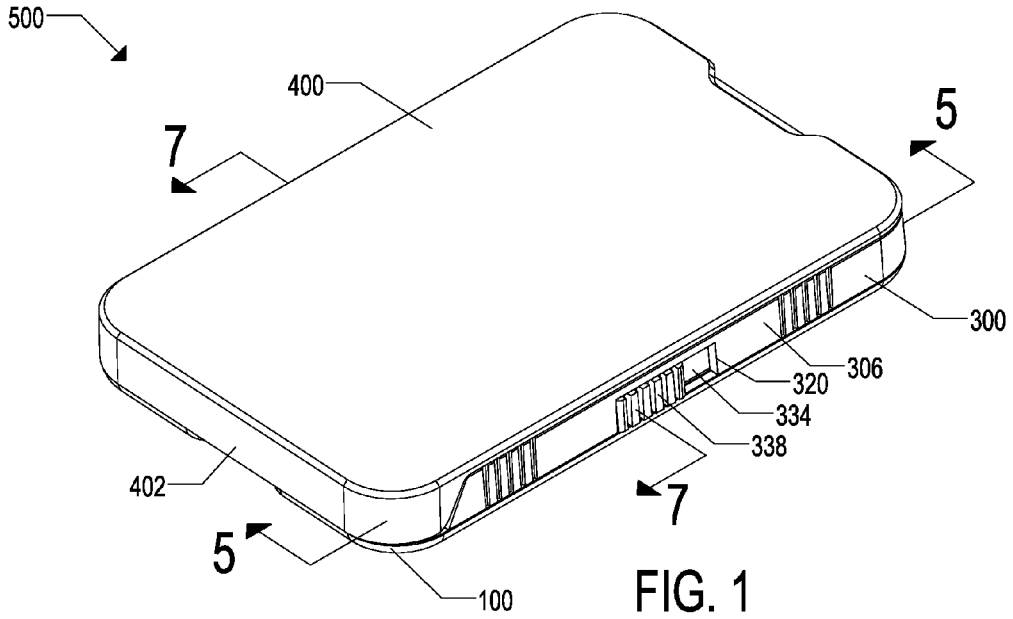
FIG. 1 illustrates schematically an axonometric view of the front side of the electromagnetic shielding card case in its closed position.
Figure 2:
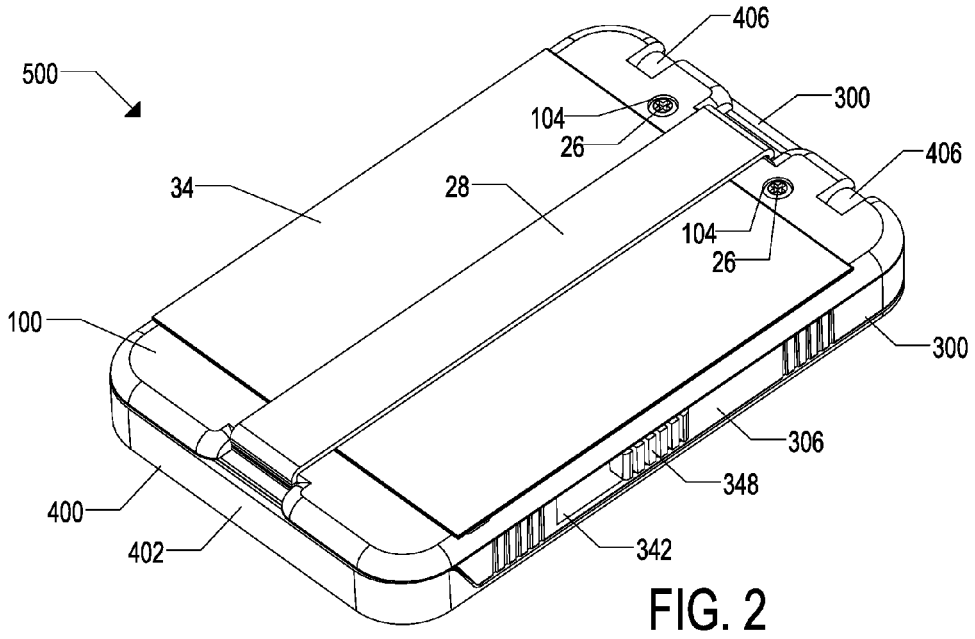
FIG. 2 illustrates schematically an axonometric view of the rear side of the electromagnetic shielding card case in its closed position and holding paper currency under the rubber strap.
Figure 3:
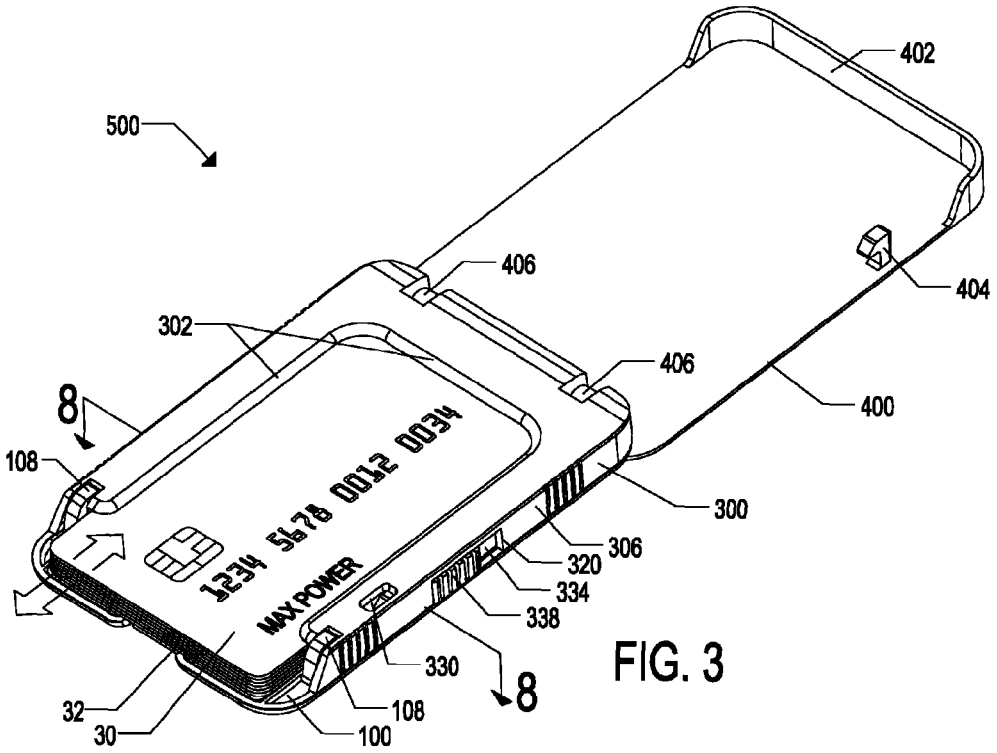
FIG. 3 illustrates schematically an axonometric view of the electromagnetic shielding card case in its open position.
Figure 4:
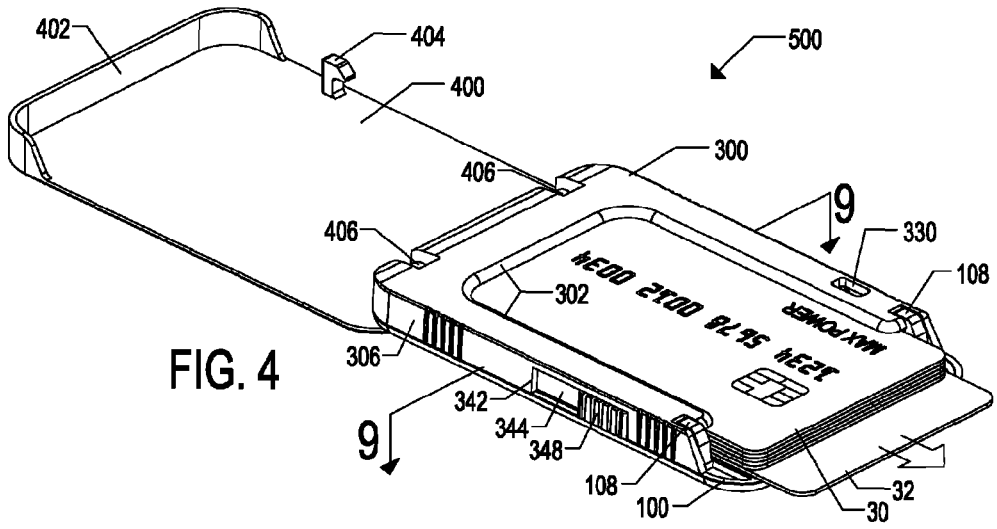
FIG. 4 illustrates schematically an axonometric view of the electromagnetic shielding card case in its open position showing the bottommost card ejected.
Figure 3A:
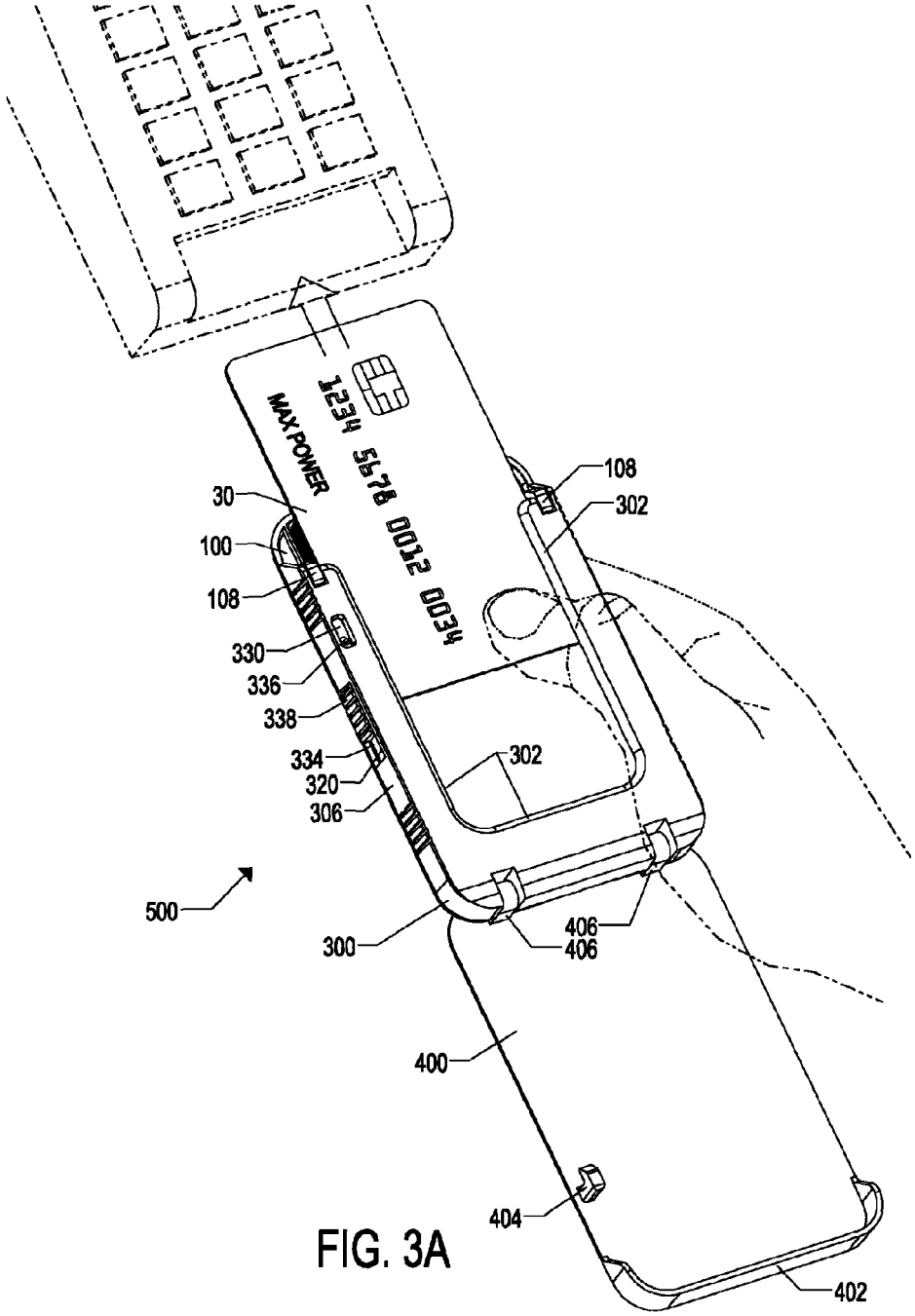
FIG. 3A illustrates schematically an axonometric view of the card case in its open position with the user ejecting and holding the topmost card out slightly with their thumb so it may be inserted into a chip and pin card reader.

As FIG. 12 shows, electromagnetic shielding member 200 has a pair of slits 202 on each of its two long sides which are inserted around high wall portions 310 which extend upwards from continuous inner wall 304. High wall portions 310 protrude through slits 202 and into narrow trenches 110 on base member 100 (seen in FIG. 7) and keeps shielding member 200 locked in place during and after assembly. The bottom of continuous inner wall 304 then rests against the top surface of shielding member 200 and a card slot is defined on its left, right, and rear sides by continuous inner wall 304, its bottom by shielding member 200, and its top by continuous roof member 302 into which a plurality of cards 30 can be inserted and removed at the front area of card case 500 when in its open position (FIGS. 3, 3A and 4).

Figure 7:
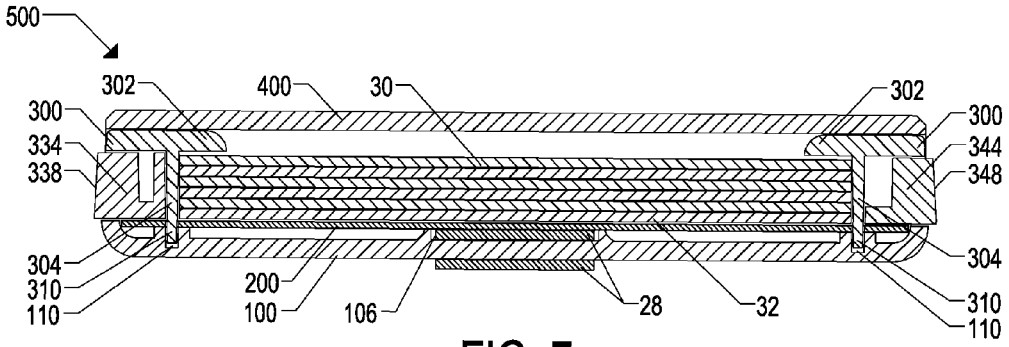
FIG. 7 illustrates schematically a vertical section through the center of the short dimension of the electromagnetic shielding card case when in its closed position, and shows how the shielding member and front panel sandwich a plurality of cards contained inside.

A rubber strap 28 wraps around the middle of base member 100 and sits within a strap trench 106 located on its interior surface wherein shielding member 200 sits on top if it and conceals it inside, which can be seen in FIG. 7. The other half of rubber strap 28 stretches and urges against the exterior surface of base member 100 and holds a variety of additional planar and paper elements such as paper currency 34 (seen in FIG. 2), business cards, regular cards, receipts, tickets and the like.

Figure 5:
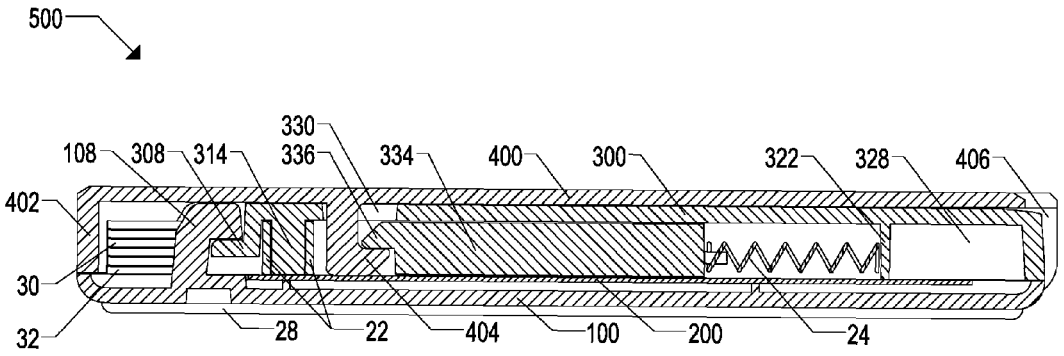
FIG. 5 illustrates schematically a vertical section through the side of the card case when in its closed position and the latch member is in its locked position.
Figure 6:
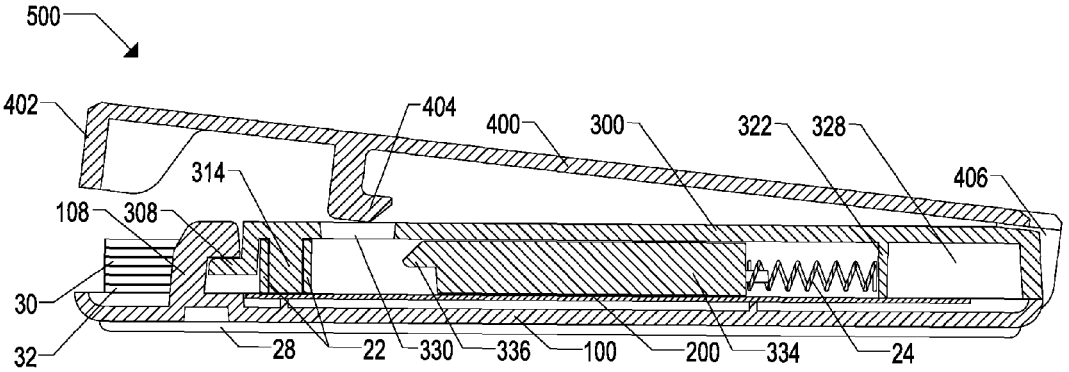
FIG. 6 illustrates schematically a vertical section through the side of the card case when the latch member is pushed backwards and the front panel is able to pivot open.

Base member 100 has a pair of upstanding hooks 108 at its front end which overlap ledge portions 308 of U-shaped member 300 as seen exploded in FIG. 12 and sectionally in FIGS. 5 and 6. A pair of thread forming screws 26 protrude through counter-bored holes 104 in base member 100 and into screw bosses 316 in U-shaped member 300, which keeps base member 100, shielding member 200, U-shaped member 300 and front panel 400 all held to each other, and allows front panel 400 to pivot open between a closed position (FIGS. 1, 2 5, and 7) and an open position (FIGS. 3, 3A, 4, 8, and 9).

Operation

It will be observed that card case 500 has two basic positions:

(i) Closed Position (FIGS. 1, 2, 5 and 7): As front panel 400 is pivoted closed, hook member 404 passes through hole 330 in U-shaped member 300 and frictionally engages the angled head of tongue 336 which is at the front of latch member 334, which causes latch member 334 to slide backwards against compression spring 24 until hook member 404 moves downwards and past tongue 336 until they are interlocked with each other, which allows electromagnetic shielding card case 500 to stay in its locked position, shown sectionally in FIG. 5. This allows a user to quickly and easily lock card case 500 automatically without the use of buttons, snaps or zippers. Continuous front wall 402 extends downwards from front panel 400 along the front edge and partially along its side edges and provides a physical barrier at the front end when card case 500 is in its closed position so cards cannot physically slide out by accident, as seen sectionally in FIG. 5.

When card case 500 is in its closed position, plurality of cards 30 are sandwiched between front panel 400 (which is made from a metal alloy with inherent electromagnetic shielding properties) and shielding member 200 so that plurality of cards 30, which may include contactless smartcards, are shielded from being scanned by an RFID reader, thereby preventing unauthorized or accidental access to one's personal card data. Moreover, in the closed position, electromagnetic shielding card case 500 is securely shut and cannot pivot open while shifting around in one's pocket or bag, thus avoiding the creation of a breach in the electromagnetic shielding effect, and also preventing any contactless smartcards contained in card case 500 from falling or sliding out slightly, which would also risk unauthorized scanning. The enclosure that is formed around plurality of cards 30 is also substantially crush resistant, as base member 100, U-shaped member 300 and front panel 400, are all made of substantially rigid materials, which allows card case 500 to resist crushing forces and protect cards inside from being bent, bowed or cracked.

(ii) Open Position (FIGS. 3, 3A, 4, 8 and 9): From its closed state, electromagnetic shielding card case 500 can be unlocked and opened by engaging ribbed button 338 on latch member 334 with one's finger and then sliding it backwards against compression spring 24 to its unlocked position (FIG. 6) which allows the user to freely pivot open front panel 400 by grabbing continuous front wall 402 and lifting it up. While in the open position, continuous front wall 402 on front panel 400 is no longer in place (seen sectionally in FIG. 6) and cards stored in the card slot are able to be slidably inserted and removed from the front of card case 500 (FIG. 3) with one's thumb by engaging the topmost card first and partially pushing out cards one at a time in a shuffling manner to sort through them. U-shaped member 300 only covers a portion of the perimeter of the topmost card in a stack, as seen in FIGS. 3 and 4, and exposes a generous amount of surface area of the topmost card so a user can easily see and engage it with their thumb with minimal effort. Moreover, the resilient rubber tubes 22 frictionally engage the edges of cards in the card slot even as cards are pushed forwards one at a time and prevents them from falling out while the case is open, and also allows the topmost card to be ejected slightly and held with one's thumb as it is inserted vertically into the bottom of a chip and pin card reader, as shown in FIG. 3A. This makes the checkout process much quicker and easier.

While in the open position, a user can also eject bottommost card 32 in the stack of plurality of cards 30 by engaging ribbed button 348 on ejecting member 344 with their finger and pushing it forwards from its resting position to its ejecting position, which causes projecting arm 346 to urge against the back edge of bottommost card 32 and push it outwards slightly from the stack (shown in FIGS. 4 and 9), allowing easy access for the user to grab it and remove it. This is an ideal location to place an I.D. card or driver's license, as it can accessed very quickly and easily when needed.

Materials and Manufacturing

In the preferred embodiment, shielding member 200 is preferably stamped or lasercut from a flat sheet of uniform thickness of aluminum alloy. As would be obvious to one skilled in the art, aluminum alloy inherently has strong electromagnetic signal blocking properties, good strength and rigidity, is very lightweight, and is readily available at a reasonable price. It is also one of the most readily recycled metals, making it a greener material. The lightness of the material is also favorable because card case 500 is meant to be carried in one's pocket or bag comfortably. As discussed, it's important that shielding member 200 is made from a durable, resilient sheet of metal instead of a specialized, expensive electromagnetic shielding foil or film in order to eliminate the threat of the shielding material bending, flaking, or tearing over time with use, which is one of the disadvantages of the aforementioned prior art.

Front panel 400 is preferably made from a metal alloy such as aluminum by CNC machining, or Computer Numerical Control machining, a subtractive process which uses a multi-axis bit to carve parts out from a solid block of metal. By machining front panel 400 from solid aluminum, it will have excellent strength and durability, resist crushing forces on card case 500 to protect cards inside it, and have excellent inherent electromagnetic shielding properties. It is also more efficient for front panel 400 to be one piece instead of multiple parts or sub-assemblies, as it has hinge members 406, continuous front wall 402, and hook member 404 already integrated into it, instead of having to use more structural layers to achieve this, which would make card case 500 more complex and expensive, thicker, and more labor intensive to build. As would be obvious to one skilled in the art, front panel 400 could be made in different colors and finishes using an aluminum anodizing process, which allows for the coloring of aluminum parts, to satisfy new trends, tastes and demands of the market.

Also in the preferred embodiment, base member 100, U-shaped member 300, latch member 334 and ejecting member 344 are all injection molded out of a durable, lightweight, and resilient plastic such as ABS or polycarbonate plastic. This again helps to add to the lightness of card case 500 so it can be comfortably carried in one's pocket or bag, and also adds to its overall crush resistance and durability. Rubber tubes 22 and rubber strap 28 are preferably made from a durable rubber material with adequate grip for holding cards, such as silicone or EPDM rubber (ethylene propylene diene monomer).

SUMMARY, RAMIFICATIONS, and SCOPE

Accordingly, the reader will see that electromagnetic shielding card case can be used to prevent unauthorized or accidental access to the contents of a plurality of cards, which may include contactless smartcards, contained within it and will not accidentally pivot open while contained in one's pocket or bag. Furthermore, the electromagnetic shielding card case has additional advantages in that:

The releasable locking means on the card case can be easily unlocked by sliding the latch member button backwards with one's finger while gripping the case, and then lifting the front panel open. Moreover, closing the front panel will allow the case to lock itself shut automatically, without the use of manual closure methods like buttons, zippers or Velcro.

A plurality of wallet-sized cards, which may include contactless smartcards or chip and pin cards, can be contained in the card slot of the case and are physically prevented from accidentally falling or sliding out of the case when it is in a closed position;

The card slot within the electromagnetic shielding card case is minimal on the top and allows a user to see a substantial portion of the top face of the topmost card which is helpful for sorting through cards in dimly lit environments or for people with poor vision. Moreover, this feature can also allow a user to display their driver's license or other cards without ever removing it from the card case;

A resilient means is located in the sides of the card slot which frictionally engages and grips the edges of a stack of cards in the slot and allows a user to easily shuffle through cards without any falling out by accident. Moreover, this allows the topmost card to be ejected slightly and held with one's thumb as it is inserted vertically into a chip and pin card reader, which is extremely intuitive and quick in a checkout line;

When the card case is open, an ejecting member allows for the bottommost card to be ejected out slightly from the bottom of the card stack and accessed quickly;

The soft, low profile rubber strap on the back of the card case allows a user to carry additional items such as paper currency, business cards, regular cards, tickets, receipts and the like without adding any sharp edges or additional bulkiness like a traditional money clip might, which feels much more comfortable in pocket;

The base member, U-shaped member and front panel are all made out of substantially rigid and durable materials which gives the card case excellent crush resistance and protects cards inside from getting bent, bowed or cracked. Moreover, when the case is closed, the continuous front wall of the front panel rests against the base member and the underside of the front panel rests against the top of U-shaped member so that there is a rigid structure on all sides which does not bow or bend under crushing forces;

Instead of using thin, flimsy electromagnetic shielding foil or metallized inks like some of the prior art, the shielding elements on the proposed electromagnetic shielding card case are rigid, durable, and will not bend, crack or break with use;

The front panel, which is made from aluminum alloy in the preferred embodiment, could be finished and anodized in different colors and styles to satisfy different trends and tastes in the market. Moreover, U-shaped member, base member, latch member and ejecting member, which are all preferably made out of plastic, could also be molded in different colors as well;

The market for contactless smartcards could be expanded by this invention by assuaging a card owners concerns over privacy and security by giving them the ability to protect the information on their contactless smartcards and the delicate chips on their chip and pin cards, which may include debit, credit, or building entry cards;

It will be appreciated that still further embodiments of the present invention will be apparent to those skilled in the art in view of the present disclosure. It is to be understood that the present invention is by no means limited to the particular constructions herein disclosed and/or shown in the drawings, but also comprises any modifications or equivalents within the scope of the invention. Accordingly, the scope of the invention should be determined not by the embodiment illustrated, but by the appended claims and their legal equivalents.

I claim:

1. An electromagnetic shielding card case for contactless and chip and pin cards, the electromagnetic shielding card case comprising:

(a) a base member comprising a generally rectangular planar shape having first, second, third and fourth sides and further comprising an interior surface and an exterior surface;

(b) an electromagnetic shielding member comprising a generally rectangular planar shape having an area that substantially covers a contactless smartcard, said electromagnetic shielding member having means for attachment to said interior surface of said base member and further comprises a top surface;

(c) a U-shaped member which comprises a generally rectangular shape and continuously extends along said second, third, and fourth sides of said base member and has means for attachment to portions of said interior surface of said base member wherein said shielding member is sandwiched between said base member and said U-shaped member, and wherein said U-shaped member further comprises a large generally rectangular opening at its center around which extends a continuous roof member which runs parallel to and is positioned slightly above said shielding member, said U-shaped member further comprises a bottom surface as well as a continuous inner wall and a continuous outer wall which are both extending downwards from said bottom surface of said U-shaped member and which both substantially extend along said second, third and fourth sides of said base member, said continuous inner wall and said continuous outer wall each further comprise a bottom end, said bottom ends of said continuous inner wall and said continuous outer wall rest against said top surface of said shielding member wherein a card slot is defined on its left, right and rear sides by said continuous inner wall, its bottom by said shielding member, and its top by said continuous roof member, and whereby an opening exists at said first side of said base member through which a plurality of cards can be slidably inserted and removed parallel to and against said shielding member, and wherein said roof member cantilevers slightly into said rectangular opening of said U-shaped member along said second, third and fourth sides and partially covers a portion of a topmost card in a stack of said plurality of cards;

(d) a front panel comprising a generally rectangular planar shape having first, second, third and fourth sides which is made from a metal alloy with sufficient electromagnetic shielding properties to block a contactless smartcard from being scanned by a radio frequency identification reader and wherein said front panel further comprises an interior surface and a continuous front wall upstanding from said interior surface of said front panel which extends along said first side and a portion of said second and fourth sides of said front panel;

(e) hinge means for rotatably linking said front panel to said base member along their respective said third sides, whereby said front panel is able to pivot open and away from said base member and said card case can be in a closed position or an open position;

(f) a releasable locking means for selectively maintaining said front panel closed against said U-shaped member to keep said card case in said closed position and prevent said front panel from accidentally pivoting open;

(g) a resilient means disposed inside said card slot for frictionally engaging cards as they are inserted or removed from said card slot to prevent them from accidentally sliding out when said card case is in said open position;

(h) a paper currency holding means affixed to said exterior surface of said base member for holding paper currency, business cards, receipts, tickets and the like;

wherein when said card case is in said closed position, said continuous front wall on said front panel sits on top of a front edge of said first side of said base member and said interior surface of said front panel rests against said U-shaped member to form a substantially rigid enclosure around said plurality of cards to prevent them from getting crushed or damaged while in said card case, and wherein said continuous front wall acts a barrier to physically prevent said plurality of cards from sliding out at said first side of said base member;

and further wherein said electromagnetic shielding member and said front panel sandwich said plurality of cards contained within said card slot to shield them from being scanned or read by a radio frequency identification scanner or reader, and further wherein said releasable locking means consistently keeps said electromagnetic shielding card case in said closed position so as to prevent a gap or vulnerability from forming in the electromagnetic shielding effect;

and whereby when said card case is in said open position, said continuous front wall on said front panel no longer restricts said plurality of cards in said card slot from sliding out and a user is able to easily see and slidably remove cards from said first side of said base member by engaging them with their thumb through said rectangular opening of said U-shaped member and pushing them out, and further whereby said resilient means allows a user to easily shuffle cards forwards without any accidentally falling out and allows said topmost card in said stack of cards to be ejected slightly from the front of said card case and held with one's thumb as it is inserted vertically into a chip and pin card reader.

2. The electromagnetic shielding card case according to claim 1, wherein said hinge means further comprises:

(a) a pair of hinge members affixed to a portion of said third side of said front panel, said hinge members each having a hole defined therethrough;

(b) a hinge pin;

(c) a hinge pin cradle portion disposed within a back edge of said U-shaped member which is shaped to receive said hinge pin;

(d) a pair of hinge pin retaining walls upstanding from a bottom surface of the back of said U-shaped member which covers both ends of said hinge pin;

whereby said hinge pin is inserted through said holes of said hinge members and the remaining exposed surfaces of said hinge pin are sandwiched between said base member and said hinge pin cradle portion on said U-shaped member and prevented from sliding back and forth by virtue of said hinge pin retaining walls.

3. The electromagnetic shielding card case according to claim 1, wherein said releasable locking means further comprises:

(a) a first track disposed along said fourth side of said base member defined on its sides by said continuous outer wall and said continuous inner wall, on its top by said bottom surface of said U-shaped member, and its bottom by said shielding member, said first track further comprises a barrier wall at its back end;

(b) a first gap in said continuous outer wall along a portion of said fourth side of said base member which exposes a portion of said first track;

(c) a latch member comprising a long narrow generally rectangular cross sectional shape with a tongue comprising an angled head at a front end, said latch member further comprises a back end and a ribbed button which protrudes through said first gap;

(d) a hole through a portion of said U-shaped member which aligns vertically over top of and exposes said tongue on said latch member;

(e) a hook member upstanding from said interior surface of said front panel which further comprises an angled head and is aligned with said tongue on said latch member;

(f) a compression spring disposed between said back end of said latch member and said barrier wall which constantly urges against said latch member to keep said tongue positioned over top of an inner portion of said hook member thereby keeping said card case in its said closed position;

wherein said latch member is located inside said first track and has slidable movement parallel to said fourth side of said base member, and whereby when a user engages said ribbed button on said latch member with their finger and slides it backwards against said compression spring, said tongue is disengaged from said inner portion of said hook member and said front panel can be pivoted open to access cards inside said card slot, and whereby when said front panel is pivoted closed, said angled head of said hook member engages said angled head of said tongue and causes said latch member to slide backwards against said compression spring until said hook member moves past said angled head of said tongue after which said compression spring automatically causes said tongue to move into said inner portion of said hook member to lock said card case shut.

4. The electromagnetic shielding card case according to claim 1, wherein said resilient means further comprises:

(a) a pair of tube bosses disposed at a front end of said U-shaped member which are upstanding from a portion of its said bottom surface, said tube bosses are located next to said continuous inner wall near said second and fourth sides of said base member;

(b) a pair of rubber tubes inserted around said tube bosses;

wherein said rubber tubes frictionally engage the edges of said stack of cards as they are inserted into said card slot and grips them so as to prevent them from falling out while said card case is in said open position.

5. The electromagnetic shielding card case according to claim 1, wherein said paper currency holding means further comprises:

(a) a strap trench that is recessed into and extends through the middle of said interior surface of said base member along its longitudinal axis;

(b) a continuous circular strap member made from rubber or elastic or the like;

wherein said strap member loops around said base member so that one half of said strap member extends through said strap trench and the other half extends along said exterior surface of said base member so that paper currency, business cards, receipts, tickets or the like may be secured and carried between said strap member and said exterior surface of said base member, and further wherein said strap member does not have any rigid or sharp features that may be uncomfortable while holding said card case in one's pocket.

6. The electromagnetic shielding card case according to claim 1, wherein said card case further comprises an ejection means for ejecting a bottommost card out from said card slot, the ejection means further comprising:

(a) a second track disposed along said second side of said base member defined on its sides by said continuous outer wall and said continuous inner wall, on its top by said bottom surface of said U-shaped member, and its bottom by said shielding member;

(b) a second gap in said continuous outer wall along a portion of said second side of said base member which exposes a portion of said second track;

(c) an ejecting member comprising a long narrow generally rectangular cross sectional shape having a back end and a front end, as well as a projecting arm extending from said back end which protrudes under a low wall portion of said continuous inner wall on said U-shaped member and into a back portion of said card slot flush against said shielding member and is the approximate thickness of one wallet sized card, said ejecting member further comprises a ribbed button which protrudes through said second gap;

wherein said ejecting member is located inside said second track and has slidable movement parallel to said second side of said base member whereby when said card case is in said open position a user may engage said ribbed button on said ejecting member and push it forwards to make said projecting arm urge against a back edge of said bottommost card in said stack of said plurality of cards and push it outwards slightly at said first side of said base member, allowing a user quick access to an individual card.

7. The electromagnetic shielding card case according to claim 1, wherein said means for attachment of said U-shaped member further comprises:

(a) a pair of counter-bored holes in said base member along its said third side;

(b) a pair of hooks upstanding from said interior surface of said base member;

(c) a pair of ledge portions disposed at an end portion of said U-shaped member which align vertically with said pair of hooks on said base member;

(d) a pair of screw bosses in an underside of said U-shaped member that align vertically with said pair of counter-bored holes in said base member;

(e) a pair of thread forming screws;

wherein said pair of hooks on said base member slide on top of said ledge portions on said U-shaped member to interlock with each other, and said pair of thread forming screws are inserted through said pair of counter-bored holes and into said screw bosses in order to securely attach said U-shaped member to said base member and keep said shielding member sandwiched between them.

8. The electromagnetic shielding card case according to claim 1, wherein said electromagnetic shielding member and said front panel are comprised of an aluminum alloy with sufficient electromagnetic shielding properties so as to prevent a contactless smartcard inside said card slot from being powered up and read by an RFID reader.

9. The electromagnetic shielding card case according to claim 1, wherein said base member and said U-shaped member are both made from a substantially rigid plastic material such as polycarbonate or ABS to provide rigidity and strength under compressive forces.

10. An electromagnetic shielding card case for contactless and chip and pin cards, the electromagnetic shielding card case comprising:

(a) a base member comprising a generally rectangular planar shape having first, second, third and fourth sides and further comprising an interior surface, an exterior surface, and a strap trench that is recessed into and extends through the middle of said interior surface of said base member along its longitudinal axis;

(b) an electromagnetic shielding member comprising a generally rectangular planar shape having an area that substantially covers a contactless smartcard, said electromagnetic shielding member having means for attachment to said interior surface of said base member and further comprises a top surface;

(c) a U-shaped member which comprises a generally rectangular shape and continuously extends along said second, third, and fourth sides of said base member and has means for attachment to portions of said interior surface of said base member wherein said shielding member is sandwiched between said base member and said U-shaped member, and wherein said U-shaped member further comprises a large generally rectangular opening at its center around which extends a continuous roof member which runs parallel to and is positioned slightly above said shielding member, said U-shaped member further comprises a bottom surface as well as a continuous inner wall and a continuous outer wall which are both extending downwards from said bottom surface of said U-shaped member and which both substantially extend along said second, third and fourth sides of said base member, said continuous inner wall and said continuous outer wall each further comprise a bottom end, said bottom ends of said continuous inner wall and said continuous outer wall rest against said top surface of said shielding member wherein a card slot is defined on its left, right and rear sides by said continuous inner wall, its bottom by said shielding member, and its top by said continuous roof member, and whereby an opening exists at said first side of said base member through which a plurality of cards can be slidably inserted and removed parallel to and against said shielding member, and wherein said roof member cantilevers slightly into said rectangular opening of said U-shaped member along said second, third and fourth sides and partially covers a portion of a topmost card in a stack of said plurality of cards;

(d) a front panel comprising a generally rectangular planar shape having first, second, third and fourth sides which is made from a metal alloy with sufficient electromagnetic shielding properties to block a contactless smartcard from being scanned by a radio frequency identification reader and wherein said front panel further comprises an interior surface and a continuous front wall upstanding from said interior surface of said front panel which extends along said first side and a portion of said second and fourth sides of said front panel;

(e) hinge means for rotatably linking said front panel to said base member along their respective said third sides, whereby said front panel is able to pivot open and away from said base member and said card case can be in a closed position or an open position;

(f) a releasable locking means for selectively maintaining said front panel closed against the top of said U-shaped member to keep said card case in said closed position and prevent said front panel from accidentally pivoting open;

(g) a resilient means disposed inside said card slot for frictionally engaging cards as they are inserted or removed from said card slot to prevent them from accidentally sliding out when said card case is in said open position;

(h) a continuous circular strap member made from rubber, elastic or the like, said strap member loops around said base member so that one half of said strap member extends through said strap trench and is covered by said shielding member and the other half extends along said exterior surface of said base member so that paper currency, business cards, extra cards, receipts, tickets or the like may be secured and carried between said strap member and said exterior surface of said base member;

wherein when said card case is in said closed position, said continuous front wall on said front panel sits on top of a front edge of said first side of said base member and said interior surface of said front panel rests against said U-shaped member to form a substantially rigid enclosure around said plurality of cards to prevent them from getting crushed or damaged while in said card case, and wherein said continuous front wall acts a barrier to physically prevent said plurality of cards from sliding out at said first side of said base member;

and further wherein said electromagnetic shielding member and said front panel sandwich said plurality of cards contained within said card slot to shield them from being scanned or read by a radio frequency identification scanner or reader, and further wherein said releasable locking means consistently keeps said electromagnetic shielding card case in said closed position so as to prevent a gap or vulnerability from forming in the electromagnetic shielding effect;

and whereby when said card case is in said open position, said continuous front wall on said front panel no longer restricts said plurality of cards in said card slot from sliding out and a user is able to easily see and slidably remove cards from said first side of said base member by engaging them with their thumb through said rectangular opening of said U-shaped member and pushing them out, and further whereby said resilient means allows a user to easily shuffle cards forwards without any accidentally falling out and allows said topmost card in said stack of cards to be ejected slightly from the front of said card case and held with one's thumb as it is inserted vertically into a chip and pin card reader.

11. The electromagnetic shielding card case according to claim 10, wherein said hinge means further comprises:

(a) a pair of hinge members affixed to a portion of said third side of said front panel, said hinge members each having a hole defined therethrough;

(b) a hinge pin;

(c) a hinge pin cradle portion disposed within a back edge of said U-shaped member which is shaped to receive said hinge pin;

(d) a pair of hinge pin retaining walls upstanding from a bottom surface of the back of said U-shaped member which covers both ends of said hinge pin;

whereby said hinge pin is inserted through said holes of said hinge members and the remaining exposed surfaces of said hinge pin are sandwiched between said base member and said hinge pin cradle portion on said U-shaped member and prevented from sliding back and forth by virtue of said hinge pin retaining walls.

12. The electromagnetic shielding card case according to claim 10, wherein said releasable locking means further comprises:

(a) a first track disposed along said fourth side of said base member defined on its sides by said continuous outer wall and said continuous inner wall, on its top by said bottom surface of said U-shaped member, and its bottom by said shielding member, said first track further comprises a barrier wall at its back end;

(b) a first gap in said continuous outer wall along a portion of said fourth side of said base member which exposes a portion of said first track;

(c) a latch member comprising a long narrow generally rectangular cross sectional shape with a tongue comprising an angled head at a front end, said latch member further comprises a back end and a ribbed button which protrudes through said first gap;

(d) a hole through a portion of said U-shaped member which aligns vertically over top of and exposes said tongue on said latch member;

(e) a hook member upstanding from said interior surface of said front panel which further comprises an angled head and is aligned with said tongue on said latch member;

(f) a compression spring disposed between said back end of said latch member and said barrier wall which constantly urges against said latch member to keep said tongue positioned over top of an inner portion of said hook member thereby keeping said card case in its said closed position;

wherein said latch member is located inside said first track and has slidable movement parallel to said fourth side of said base member, and whereby when a user engages said ribbed button on said latch member with their finger and slides it backwards against said compression spring, said tongue is disengaged from said inner portion of said hook member and said front panel can be pivoted open to access cards inside said card slot, and whereby when said front panel is pivoted closed, said angled head of said hook member engages said angled head of said tongue and causes said latch member to slide backwards against said compression spring until said hook member moves past said angled head of said tongue after which said compression spring automatically causes said tongue to move into said inner portion of said hook member to lock said card case shut.

13. The electromagnetic shielding card case according to claim 10, wherein said resilient means further comprises:

(a) a pair of tube bosses disposed at a front end of said U-shaped member which are upstanding from a portion of its said bottom surface, said tube bosses are located next to said continuous inner wall near said second and fourth sides of said base member;

(b) a pair of rubber tubes inserted around said tube bosses;

wherein said rubber tubes frictionally engage the edges of said stack of cards as they are inserted into said card slot and grips them so as to prevent them from falling out while said card case is in said open position.

14. The electromagnetic shielding card case according to claim 10, wherein said card case further comprises an ejection means for ejecting a bottommost card out from said card slot, the ejection means further comprising:

(a) a second track disposed along said second side of said base member defined on its sides by said continuous outer wall and said continuous inner wall, on its top by said bottom surface of said U-shaped member, and its bottom by said shielding member;

(b) a second gap in said continuous outer wall along a portion of said second side of said base member which exposes a portion of said second track;

(c) an ejecting member comprising a long narrow generally rectangular cross sectional shape having a back end and a front end, as well as a projecting arm extending from said back end which protrudes under a low wall portion of said continuous inner wall on said U-shaped member and into a back portion of said card slot flush against said shielding member and is the approximate thickness of one wallet sized card, said ejecting member further comprises a ribbed button which protrudes through said second gap;

wherein said ejecting member is located inside said second track and has slidable movement parallel to said second side of said base member whereby when said card case is in said open position a user may engage said ribbed button on said ejecting member and push it forwards to make said projecting arm urge against a back edge of said bottommost card in said stack of said plurality of cards and push it outwards slightly at said first side of said base member, allowing a user quick access to an individual card.

15. The electromagnetic shielding card case according to claim 10, wherein said means for attachment of said U-shaped member further comprises:

(a) a pair of counter-bored holes in said base member along its said third side;

(b) a pair of hooks upstanding from said interior surface of said base member;

(c) a pair of ledge portions disposed at an end portion of said U-shaped member which align vertically with said pair of hooks on said base member;

(d) a pair of screw bosses in the underside of said U-shaped member that align vertically with said pair of counter-bored holes in said base member;

(e) a pair of thread forming screws;

wherein said pair of hooks on said base member slide on top of said ledge portions on said U-shaped member to interlock with each other, and said pair of thread forming screws are inserted through said pair of counter-bored holes and into said screw bosses in order to securely attach said U-shaped member to said base member and keep said shielding member sandwiched between them.

16. The electromagnetic shielding card case according to claim 10, wherein said electromagnetic shielding member and said front panel are comprised of an aluminum alloy with sufficient electromagnetic shielding properties so as to prevent a contactless smartcard inside said card slot from being powered up and read by an RFID reader.

17. The electromagnetic shielding card case according to claim 10, wherein said base member and said U-shaped member are both made from a substantially rigid plastic material such as polycarbonate or ABS to provide rigidity and strength under compressive forces.

* * * * *